US010016038B2

(12) United States Patent
Treadwell

(10) Patent No.: US 10,016,038 B2
(45) Date of Patent: Jul. 10, 2018

(54) ANTLERS NOVELTY CADDY

(71) Applicant: Juanita Treadwell, Mesita, CO (US)

(72) Inventor: Juanita Treadwell, Mesita, CO (US)

(73) Assignee: Juanita Treadwell, Mesita, CO (US)

( * ) Notice: Subject to any disclaimer, the term of this patent is extended or adjusted under 35 U.S.C. 154(b) by 46 days.

(21) Appl. No.: 15/212,201

(22) Filed: Jul. 16, 2016

(65) Prior Publication Data

US 2017/0035168 A1 Feb. 9, 2017

Related U.S. Application Data

(60) Provisional application No. 62/201,409, filed on Aug. 5, 2015.

(51) Int. Cl.

| | |
|---|---|
| ***B65D 73/00*** | (2006.01) |
| ***A45C 11/24*** | (2006.01) |
| ***A42B 1/00*** | (2006.01) |
| ***A45F 5/02*** | (2006.01) |
| *B65D 81/36* | (2006.01) |
| *B65D 41/04* | (2006.01) |
| *B65D 43/02* | (2006.01) |
| *A45C 13/08* | (2006.01) |

(52) U.S. Cl.

CPC ..... *A45C 11/24* (2013.01); *A42B 1/004* (2013.01); *A45F 5/02* (2013.01); *A45C 13/08* (2013.01); *B65D 41/04* (2013.01); *B65D 43/02* (2013.01); *B65D 81/365* (2013.01)

(58) Field of Classification Search

CPC ..... B65D 81/365; B65D 41/04; B65D 41/16; B65D 25/20; B65D 43/02; B65D 43/0225; A45C 11/24; A45C 13/08; A42B 1/004; A45F 5/02

USPC ..... 206/457, 458, 8; 102/293

See application file for complete search history.

(56) References Cited

U.S. PATENT DOCUMENTS

| | | | | |
|---|---|---|---|---|
| 5,803,266 | A * | 9/1998 | Blackwelder | A42B 1/24 2/209.13 |
| 8,522,725 | B1 * | 9/2013 | Moore | A01K 15/02 119/707 |
| 2012/0145720 | A1 * | 6/2012 | Hicks | A45C 3/00 220/592.2 |
| 2012/0227295 | A1 * | 9/2012 | Miller | G09F 3/201 40/304 |
| 2014/0166714 | A1 * | 6/2014 | Peisley | A45F 3/04 224/645 |
| 2014/0378758 | A1 * | 12/2014 | Mankin | A61H 19/44 600/38 |
| 2015/0044939 | A1 * | 2/2015 | Meter | A01M 31/04 446/419 |

* cited by examiner

*Primary Examiner* — Luan K Bui

(57) ABSTRACT

The present invention is a antlers novelty caddy. The present invention provides a effective storage of items and a method for attachment(s). In particular, the present invention can be pinned to caps, hats, backpacks, or just about anything that comes to mind; and, the present invention can be placed and held on a magnetically metal surface, such as a refrigerator or in areas where there is a magnetic metal surface. In particular, the present invention provides a user easy access to items.

3 Claims, 3 Drawing Sheets

ANTLERS NOVELTY CADDY

The present invention relates to an antlers molded novelty caddy.

BACKGROUND

Regular antlers novelties do not store items and do not allow the novelty to be attached to caps, hats, backpacks, or just about anything that comes to mind; and, regular antlers novelties do not have a storage chamber with a attachment area allowing it to be held on a magnetically metal surface, such as a refrigerator and other things.

Presently there is no solution for people to carry around a molded antlers storageable novelty caddy; and, there is no solution to have easy access to items in another convenient way held on a magnetically metal surface.

SUMMARY

The present invention seeks to provide a solution to this problem by providing the molded antlers novelty caddy, comprising: a preferably configured element to resemble antlers, a removable molded cap element to resemble a antler base, a built-in accessible storage chamber element, and a attachment member area, the molded antlers novelty caddy configured so that it is attachable, wherein when the antler base cap is openable and closable via a user, a stored item is easily accessible to the user.

The present invention, seeks to provide a solution by providing the molded antlers novelty caddy which can be attached to caps, hats, backpacks, or just about anything that comes to mind; and, it seeks to provide a solution to this problem by providing the molded antlers novelty caddy for easy access to items. The present invention can be placed and held on a magnetically metal surface, such as a refrigerator.

In particular, the present invention provides the method for storage with a convenient way to carry around the antlers novelty caddy which can be attached to caps, hats, backpacks, or just about anything that comes to mind. In particular, the present invention provides the method for storage and the magnetic method. In particular, the present invention provides a user easy access to items.

The molded antlers novelty caddy comes with a cap.

The molded antlers novelty caddy provides the compartment for storage.

The molded antlers novelty caddy provides the magnetic method.

The molded antlers novelty caddy attachment area is on the back.

The present invention will now be more particularly described, with reference to the accompanying drawings, by way of example only and in no way limiting the scope of the invention, in which.

DETAILED DESCRIPTION

Figure 1:
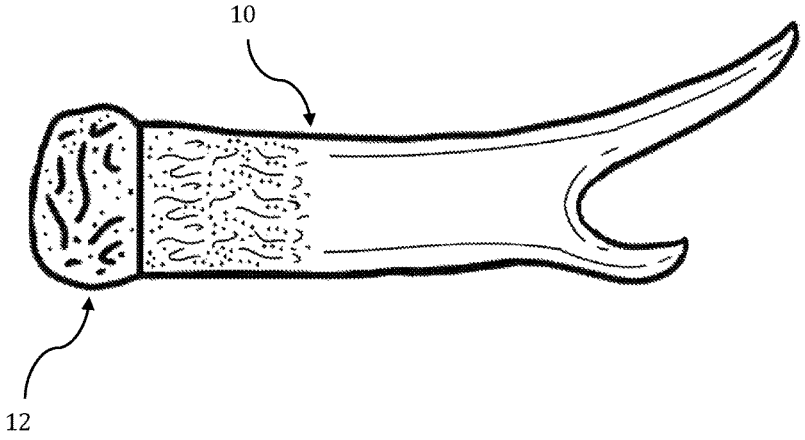
FIG. 1 is a top view of the molded antlers novelty caddy with a particular reference to the molded slip fit press on antler base cap member.
Figure 2:
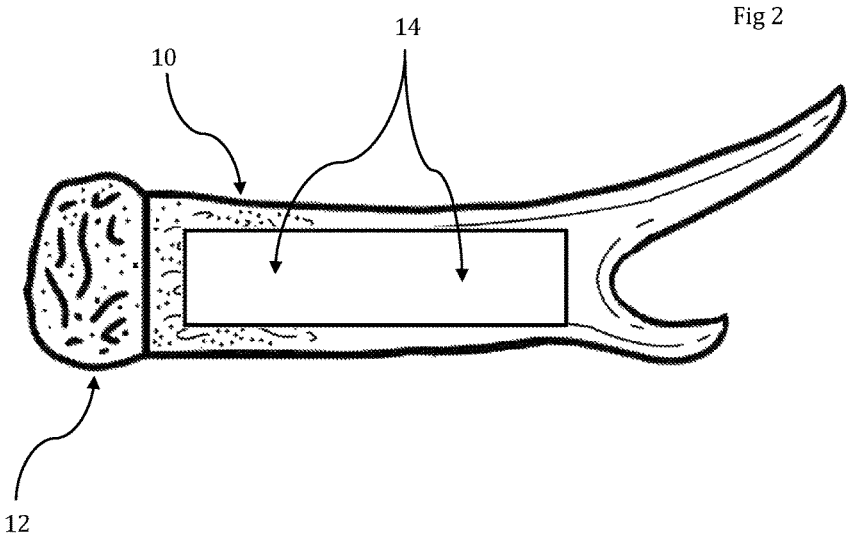
FIG. 2 is a back view of the molded antlers novelty caddy with particular reference to the attachment area.
Figure 3:
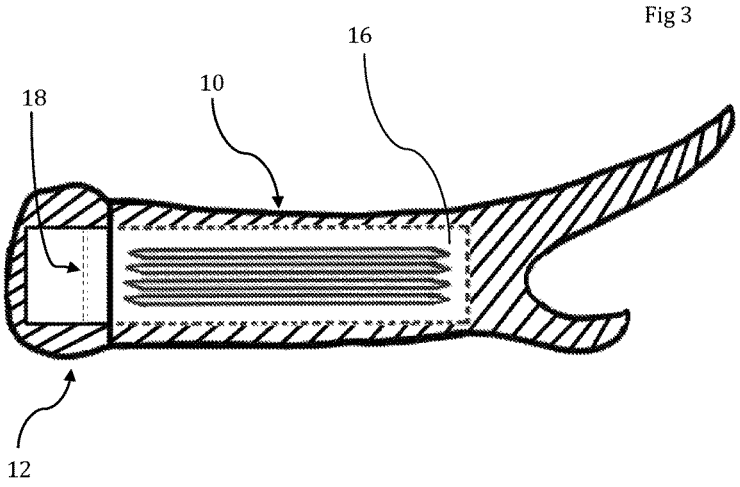
FIG. 3 is a cross-section of the molded antlers novelty caddy and the molded slip fit pressed on antler base cap combination of the present invention, in which the storage chamber is filled with toothpicks.
Figure 4:
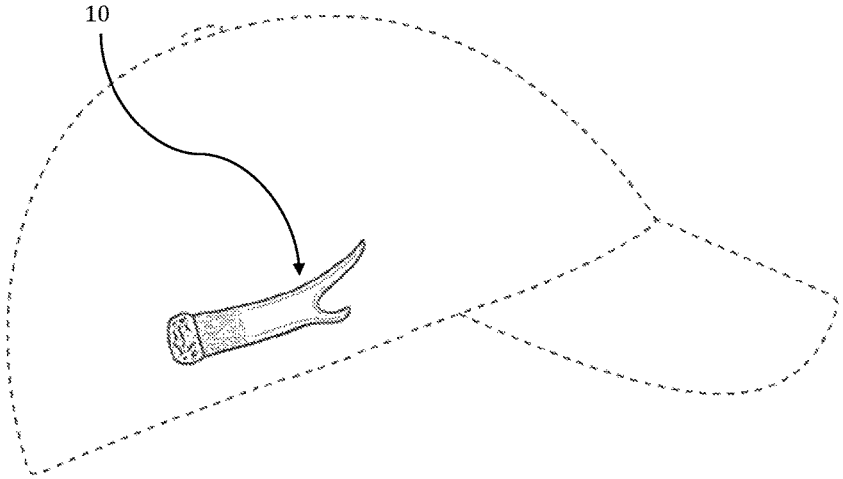
FIG. 4 is a top view of the antlers novelty caddy pinned to a baseball cap.
Figure 5:
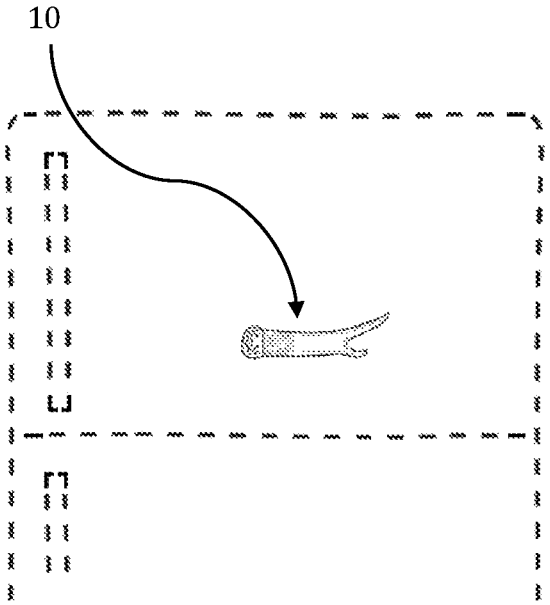
FIG. 5 is a top view of the antlers novelty magnetic caddy on a refrigerator.

Referring to the drawings, there is shown the molded antlers novelty caddy 10, comprising: the molded removable antler base cap 12 element; the attachment member area 14; and the built-in accessible storage chamber 16 element; the molded antlers novelty caddy 10 configured so that it is attachable, wherein when the molded antler base cap 12 element is openable and closable via a user, a stored item is easily accessible to the user.

There is shown the molded detachable antler base cap 12 configured to resemble an antlers base for accessing the storage chamber 16 located within the molded antlers novelty caddy 10.

Referring to the attachments area 14 is for illustration purposes only.

The built-in accessible storage chamber 16 is to hold and transport items.

Referring to the slip fit press on 18 is for illustration purposes only.

The invention will now be described in use, with reference to a preferred embodiment, in no way limiting a scope of the invention.

In use, when the molded antlers novelty caddy is attached to a cap, hat, backpack, or just about anything that comes to mind, a user no longer has to go searching for a item; and, when in use such as placed and held on a magnetically metal surface such as a refrigerator the molded antlers novelty caddy provides a user easy access to the item.

Without the invention a user would have to go looking for the item.

The embodiments described above are provided by way of example only, and various other modifications will be apparent to persons skilled in the art without departing from the scope of the invention as defined in the appended claims.

The invention claimed is:

1. A molded antler novelty caddy for holding toothpicks or others, the caddy comprising:

a molded configured antler having a built-in accessible storage chamber element for holding the toothpicks or others;

a molded removable antler base cap element is configured to either close an opening of the storage chamber element to prevent access to the toothpicks or others or to open the opening to provide access to the toothpicks or others disposed within the storage chamber element; and and an attachment member disposed on the molded antler for attaching the caddy to an object;

wherein the caddy is configured so that when the antler base cap element is openable and closable via a user, the toothpicks or others are easily accessible to the user.

2. The molded antler novelty caddy as claimed in claim 1, wherein the removable antler base cap element is at least one of: slip fit; and press on.

3. The molded antler novelty caddy as claimed in claim 1, wherein the attachment member is at least one of: tie tacks; and magnet.

* * * * *